United States Patent [19]

Dacunto

[11] 4,171,651

[45] Oct. 23, 1979

[54] POWER DRIVEN WRENCH ASSEMBLY

[75] Inventor: Alfred V. Dacunto, Cheshire, Conn.

[73] Assignee: Brimatco Corporation, Cheshire, Conn.

[21] Appl. No.: 865,938

[22] Filed: Dec. 30, 1977

[51] Int. Cl.[2] ..... B25B 17/00

[52] U.S. Cl. ..... 81/57.29

[58] Field of Search ..... 81/57.29, 57.30; 206/1.5; 220/331, 3.8; 174/67

[56] References Cited

U.S. PATENT DOCUMENTS

| | | | |
|---|---|---|---|
| 858,892 | 7/1907 | Moss | 81/57.29 |
| 946,646 | 1/1910 | Pratt | 220/3.8 |
| 1,327,991 | 1/1920 | Gatewood | 81/57.3 |
| 1,346,505 | 7/1920 | Mitchell | 81/57.3 |
| 2,341,775 | 2/1944 | Hawk | 81/57.3 |
| 3,602,071 | 8/1971 | Juhasz | 81/57.3 |
| 3,987,692 | 10/1976 | Lesner et al. | 81/57.29 |

*Primary Examiner*—James L. Jones, Jr.

*Attorney, Agent, or Firm*—McCormick, Paulding & Huber

[57] ABSTRACT

A power driven socket wrench is assembled with the drive adaptor by positioning a rotary output shaft on the drive adaptor in coupled engagement in a rotary drive socket journaled in the wrench housing and swiveling the wrench about the axis of the output shaft to position a single clamping screw, threadably engaged with the drive adaptor, within an arcuate slot in the wrench housing. The slot has a center of curvature coincident with the axis of the drive socket and opens through one side of the wrench housing. The wrench unit seats in a shallow channel in the drive adaptor and may be connected with or removed from the drive adaptor by loosening the clamping screw which remains connected to the drive adaptor.

15 Claims, 9 Drawing Figures

FIG. 1
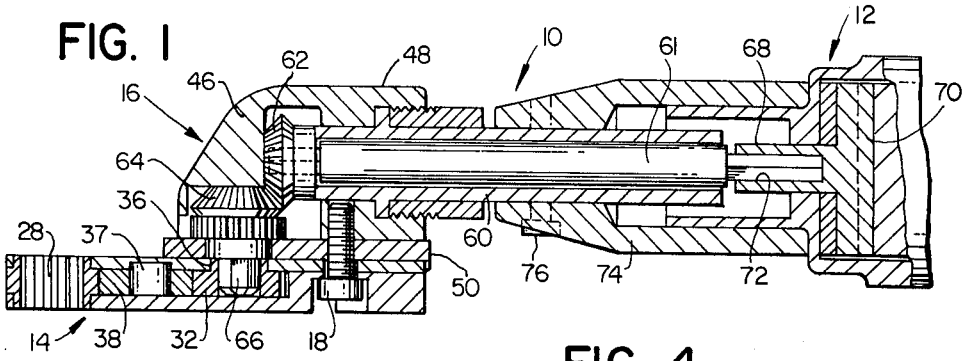
FIG. 2
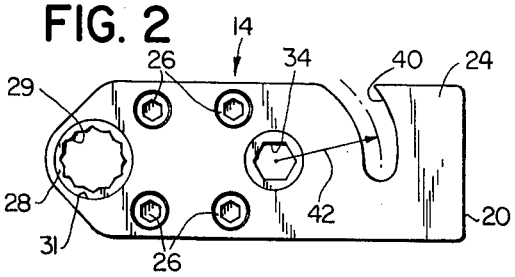
FIG. 4
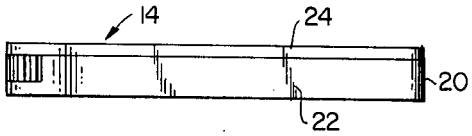
FIG. 5
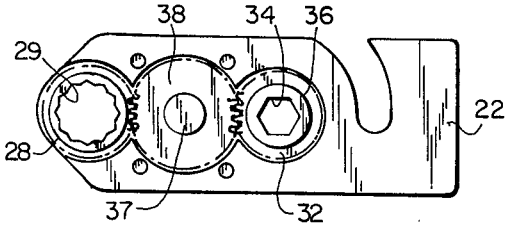
FIG. 3
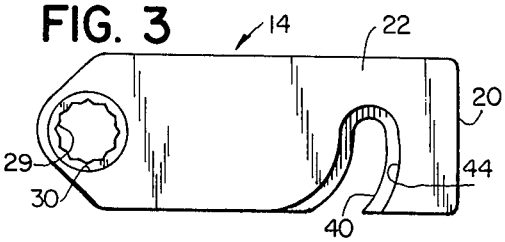
FIG. 7
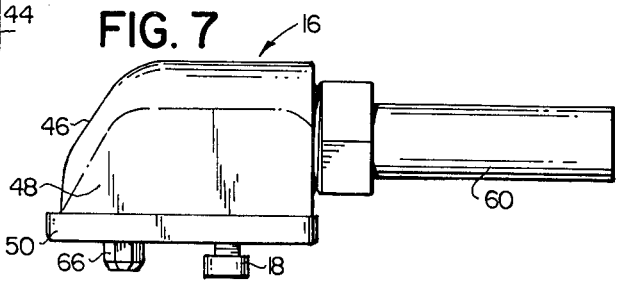
FIG. 6
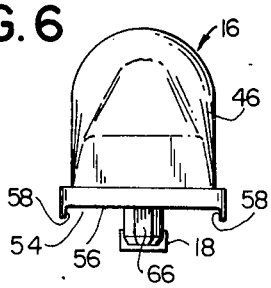
FIG. 8
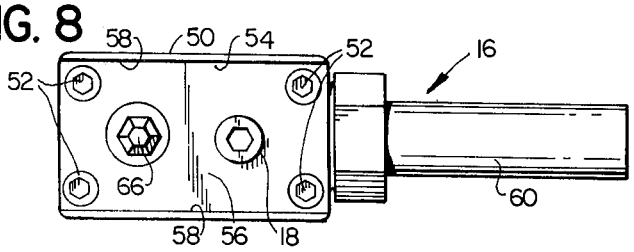
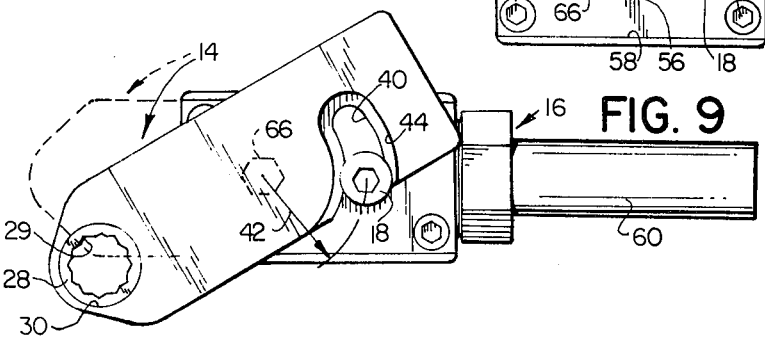
FIG. 9

POWER DRIVEN WRENCH ASSEMBLY

BACKGROUND OF THE INVENTION

This invention relates in general to power driven wrenches and deals more particularly with an improved power operated socket wrench assembly of the type which includes a removable socket wrench unit particularly adapted for driving and setting nuts situated in relatively inaccessible locations. Socket wrench assemblies of the aforedescribed type heretofore available have generally included a wrench unit held in assembly with an associated drive unit by a plurality of fasteners which must be removed to release the wrench unit from assembly with its drive unit. While such power tools are generally well suited for long run production, the time required to separate one wrench unit from its drive unit and substitute another wrench unit of a different size render such a tool unsuitable for general purpose use or short run production where frequent changes of wrench size may be required. The present invention is concerned with this problem.

SUMMARY OF THE INVENTION

In accordance with the present invention a power operated wrench assembly is provided which comprises a wrench which has an elongated housing containing a rotary socket member, a rotary drive member and drive means for rotating the socket member in response to rotation of the drive member. A slot formed in the housing opens through one of its side walls. The assembly further includes a drive adaptor which has a casing, a rotary input member journalled in the casing for connection to a rotary power unit, and a rotary output member journalled in the casing in spaced relation to the input member. A single clamping fastener extends through the slot in the wrench housing and engages the casing of the drive adaptor to releasably retain the wrench unit in assembly with the drive adaptor with the rotary output member in driving engagement with the drive member.

IN THE DRAWING

FIG. 1 is a longitudinal sectional view showing a power operated wrench assembly embodying the invention connected to a drive unit.

FIG. 2 is a plan view of the wrench of FIG. 1.

FIG. 3 is a bottom view of the wrench of FIG. 1.

FIG. 4 is a side elevational view of the wrench of FIG. 1.

FIG. 5 shows the wrench of FIG. 1 with its cover removed.

FIG. 6 is a front end elevational view of the drive adaptor of FIG. 1.

FIG. 7 is a side elevational view of the drive adaptor of FIG. 1.

FIG. 8 is a bottom view of the drive adaptor or FIG. 1.

FIG. 9 is a bottom view of the wrench assembly of FIG. 1 and illustrates the manner in which the wrench is assembled with the drive adaptor.

DETAILED DESCRIPTION OF PREFERRED EMBODIMENT

Turning now to the drawing and referring particularly to FIG. 1, a power operated wrench assembly embodying the present invention and indicated generally by the reference numeral 10 is shown connected to a power unit, indicated generally at 12, which drives it. The wrench assembly 10 is particularly adapted for running and setting nuts situated in places inaccessible to wrenches of ordinary type and comprises a wrench indicated generally at 14 and a drive unit or adaptor designated generally by the numeral 16 which provides offset drive connection between the wrench 14 and the drive unit 12. The wrench 14 is releasably retained in assembly with the drive adaptor 16 by a single fastener or clamping screw 18 which threadably engages the drive adaptor. The wrench is further arranged so that it may be rapidly connected to or disconnected from the drive adaptor without removing the clamping screw 18, all of which will be hereinafter further discussed.

Considering now the wrench assembly 10 in further detail, and referring to FIGS. 2–5, the wrench 14 has an elongated generally rectangular hollow housing 20 which includes a body 22 and a cover 24 secured to the body by a plurality of threaded fasteners 26, 26. A socket gear 28 journalled for rotation in the housing, at its forward end, has a central multi-sided socket opening 29 adapted to receive a nut in non-rotatable engagement therein. The socket opening 29 is exposed within cylindrical apertures 30 and 31, respectively, formed in the body 22 and in the cover 24. The latter apertures receive cylindrical portions of reduced diameter formed on the socket gear 28 and provide journals for the socket gear. A rotary drive member or drive gear 32 is journalled in the housing in spaced relation to the socket gear 28 for rotation about an axis parallel to the axis of the socket gear. The drive gear 32 has a central upwardly opening hexagonal socket 34 and a cylindrical portion 36 of reduced diameter at its upper end which is received within a cylindrical journal aperture in the cover 24, as best shown in FIG. 1.

One or more idler gears provide driving connection between the drive gear 32 and the socket gear 28. The illustrated wrench 14 has a single idler gear 38 journalled on an axel 37 mounted on the body 22, as shown in FIG. 5, however, one or more additional idler gears may be provided to form a drive train between the drive gear and the socket gear, whereby the wrench may be provided with a longer housing to suit a particular working requirement.

As previously noted, the wrench 14 is adapted to be quickly connected to or disconnected from the drive adaptor 10 and for this reason an arcuate slot 40 is formed in the housing between the socket gear 32 and the rear end of the housing. The slot 40 has a center of curvature coincident with the axis of the drive gear 32, extends generally transversely of the housing, and opens through one side edge thereof. In FIGS. 2 and 9 the radius of curvature of the slot 40 is indicated by the numeral 42. An arcuate recess 44 somewhat wider than the slot 40 communicates with the slot and opens through the bottom surface of the body 22 as best shown in FIGS. 3 and 9 to accommodate the head of the clamping screw 18.

The drive adaptor used to practice the invention may vary in form in accordance with the specific requirements for a given wrench application. Thus, for example, the drive adaptor may provide speed reduction between the power unit and the wrench or may be arranged to satisfy a specific offset drive requirement for a particular wrench application. However, the illustrated drive adaptor 16 provides a 90° drive offset between the power unit 12 and the wrench 14 without speed reduction. The drive adaptor 16 has a hollow casing 46 formed by a body 48 and a cover 50 which is releasably secure to the lower side of the body by a plurality of threaded fasteners 52, 52 as best shown in FIG. 8. A shallow downwardly opening generally U-shaped channel 54 is formed in the cover 50 and is defined by the lower surface of the cover indicated at 56 and a pair or inwardly facing opposed side walls 58, 58, as best shown in FIGS. 6 and 8. The width of the channel 54 is substantially equal to the width of an associated portion of the wrench housing 20 to be received therein. An elongated barrel housing 60 is secured to the rear of the casing body 48 and extends rearwardly therefrom to provide journal support for an elongated input shaft 61 which has a bevel gear 62 mounted at its forward end. The gear 62 intermeshes with another bevel gear 64 contained within the casing and drivingly associated with an output shaft 66 which is journalled in the casing 46 and projects from the bottom wall 56 outwardly beyond the channel 54. The clamping screw 18 is threadably engaged with the cover 50 in parallel relation to the axis of the output shaft 66. The axis of the clamping screw 18 is spaced rearwardly of the axis of the output shaft 66 a distance substantially equal to the radius of curvature 42.

The drive adaptor 10 may be arranged for connection to any suitable power unit having a rotary drive element. The illustrated power unit 12 comprises a conventional reversible rotary air motor of a trigger operated type and includes a rotary output member 68 connected to the air motor through a slip clutch 70. The drive member 68 has an hexagonal central socket 72 within which is disposed an hexagonal end portion of the input shaft 61. The barrel housing 60 is held in fixed aligned relationship with the casing of the air motor 12 by a split housing member 74 on the air motor which is secured in gripping relation with the barrel housing 60 by a clamping screw 76 within one side thereof.

In assemblying the wrench 14 with the drive adaptor 16 the clamping screw 18 is loosened, but need not be removed from the adaptor 16. The output drive shaft 66 is first positioned in the socket aperture 34 with the wrench in an angularly offset position relative to the drive adaptor, as it appears in full lines in FIG. 9. Thereafter, the wrench 14 is pivoted or swivelled about the axis of the output shaft 66 and in a clockwise direction from its full line to its broken line position of FIG. 9 to engage the clamping screw 18 in the slot 40. When the wrench 14 is longitudinally aligned with the drive adaptor 16, as it appears in broken lines in FIG. 9, it is seated in the channel 54. Thereafter, the clamping screw 18 is tightened to releasably secure the wrench 14 in assembly with the drive adaptor 16. The channel side walls 58, 58 cooperate with the associated portions of the housing 20 to prevent angular movement of the wrench relative to the drive unit.

The wrench 14 may be rapidly removed from the drive adaptor 16 to facilitate a quick change of wrench size by merely loosening the clamping screw 18 a sufficient amount to allow the wrench 14 to escape from the shallow channel 54 so that it may be swivelled to a released position.

I claim:

1. A power operated wrench assembly comprising a wrench and a drive unit, said drive unit having a casing, a rotary output member journalled in said casing, and clamping means for releasably securing said wrench in assembly with said drive unit and comprising a single clamping fastener secured to said drive unit and movable relative to said drive unit between clamping and releasing positions relative to said wrench, said wrench including an elongated housing, a socket member journalled in said housing near one of said housing and having an exposed multi-sided socket opening for receiving a nut in non-rotatable engagement therein, a rotary drive member journalled in said housing in spaced relation to said socket member and coaxially coupled in driving relation to said rotary output member, and drive means contained in said housing for rotating said socket member in response to rotation of said drive member, said housing having a slot therein opening through upper and lower surfaces of said housing and through one side of said housing, said slot being disposed along an arc having a center of curvature coincident with the axis of rotation of said rotary drive member, said single clamping fastener extending through said slot and clampingly engaging said housing in said clamping position, said housing being pivotally movable relative to said casing and about the common axis of said rotary output member and said drive member when said rotary output member and said drive member are in coupled relation and said clamping fastener is in said releasing position so that said wrench may be assembled with or disassembled from said drive unit.

2. A power operated wrench assembly as set forth in claim 1 including means for restraining said wrench against angular movement relative to said drive unit when said wrench is retained in assembly with said drive unit by said clamping means.

3. A power operated wrench assembly as set forth in claim 2 wherein said restraining means comprises a channel formed in said drive unit receiving an associated portion of said housing therein.

4. A power operated wrench assembly as set forth in claim 1 wherein said slot is an arcuate slot and has a center of curvature coincident with the axis of said rotary drive member.

5. A power operated wrench assembly as set forth in claim 4 wherein said slot is formed in a portion of said housing between said rotary drive member and the end of said housing opposite said one end.

6. A power operated wrench assembly as set forth in claim 4 wherein said housing has an arcuate recess formed therein and opening through one surface thereof and communicating with said slot for receiving the head of said clamping fastener therein.

7. A power operated wrench assembly as set forth in claim 1 wherein said clamping fastener comprises a clamping screw threadably engaged in said casing.

8. A power operated wrench for attachment to a drive unit having a rotary output member, said wrench having a longitudinally elongated housing, a socket member journalled for rotation in said housing near one end thereof and having a multi-sided socket opening adapted for driving engagement with a nut received therein, a rotary drive member journalled for rotation in said housing and longitudinally spaced from said socket member, means for coaxially coupling said drive member to the rotary output member, drive means in said housing for rotating said socket member in response to rotation of said drive member, and means for releasably securing said wrench to said drive unit with said drive member coupled to the rotary output member by said coupling means and comprising a slot opening through the upper and lower surfaces of said housing and through one side of said housing, said slot being disposed generally along an arc having a center of curvature coincident with the axis of rotation of said rotary drive member.

9. A power operated wrench as set forth in claim 8 wherein said slot is an arcuate slot and has a center of curvature coincident with the axis of said drive member.

10. A power operated wrench as set forth in claim 9 wherein said housing has an arcuate recess formed therein having a width greater than the width of said slot and communicating with said slot and having a center of curvature coincident with the center of curvature of said slot.

11. A power operated wrench as set forth in claim 8 wherein said slot is formed in said housing between said drive member and the end of said housing opposite said one end.

12. A drive adaptor for releasably connecting a power operated wrench to a power unit having a rotary drive element, the wrench having a housing, rotary drive socket journalled in said housing, and an arcuate slot formed in the housing and opening through one side edge of the housing and having a center of curvature coincident with the axis of rotation of the drive socket, said drive adaptor comprising a casing having an outwardly opening channel for receiving an associated portion of the wrench housing and defined by a bottom wall and a pair of opposing side walls for engaging the opposite side edges of the wrench housing, a rotary input member journalled in said casing and adapted for driving connection to the rotary drive element, a rotary output member contained within said casing and journalled in said casing for rotation about an axis normal to said bottom wall and projecting from said bottom wall and beyond said channel for coaxial driving engagement with the rotary socket member, means drivingly connecting said input member to said output member for rotating said output member in response to rotation of said input member, and means for releasably securing the wrench in assembly with said drive adaptor and comprising a single axially elongated clamping screw threadably engaged in said casing and projecting from said bottom wall in axially parallel relation to said rotary output member and beyond said channel, axis of said clamping screw being spaced from the axis of said output member a distance substantially equal to the radius of curvature of the slot in the wrench housing.

13. A power operated wrench assembly as set forth in claim 1 wherein said assembly includes a power unit having a rotary drive element and said drive unit comprises a drive adaptor for releasably connecting said wrench to said power unit and having a rotary input member journalled in said casing and drivingly connected to said rotary drive element and means for restraining said wrench against angular movement relative to said casing when said wrench is releasably secured to said drive adaptor by said clamping means.

14. A power operated wrench assembly as set forth in claim 13 wherein said restraining means comprises a channel formed in said drive adaptor for receiving an associated portion of said housing therein.

15. A power operated wrench as set forth in claim 8 wherein said drive means is wholly enclosed within said housing.

* * * * *